US007419353B2

(12) United States Patent
Guemmer

(10) Patent No.: US 7,419,353 B2
(45) Date of Patent: Sep. 2, 2008

(54) BLADE OF A TURBOMACHINE WITH BLOCK-WISE DEFINED PROFILE SKELETON LINE

(75) Inventor: Volker Guemmer, Blankenfelde-Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 11/510,826

(22) Filed: Aug. 28, 2006

(65) Prior Publication Data

US 2007/0053779 A1 Mar. 8, 2007

(30) Foreign Application Priority Data

Sep. 5, 2005 (DE) ..... 10 2005 042 115

(51) Int. Cl.
*F01D 5/14* (2006.01)

(52) U.S. Cl. ..... 415/191; 416/243; 416/DIG. 2

(58) Field of Classification Search ..... 416/223 R, 416/243, DIG. 2; 415/191, 211.2
See application file for complete search history.

(56) References Cited

U.S. PATENT DOCUMENTS

| | | | | |
|---|---|---|---|---|
| 4,431,376 | A | 2/1984 | Lubenstein | |
| 5,312,230 | A | 5/1994 | Oda | |
| 5,707,206 | A * | 1/1998 | Goto et al. | 415/173.1 |
| 6,244,817 | B1 * | 6/2001 | Ngo | 415/119 |
| 6,299,412 | B1 | 10/2001 | Wood | |

FOREIGN PATENT DOCUMENTS

| | | |
|---|---|---|
| CA | 2324951 | 9/1999 |
| DE | 4243052 B4 | 6/1993 |
| DE | 69820853 T2 | 1/2004 |
| EP | 0661413 B1 | 8/1998 |
| EP | 1106835 A2 | 6/2001 |
| EP | 1106836 | 6/2001 |

* cited by examiner

*Primary Examiner*—Ninh H Nguyen
(74) *Attorney, Agent, or Firm*—Timothy J. Klima

(57) ABSTRACT

A turbomachine blade with a profile skeleton line extending along a meridional flow line, the blade being radially divided into at least three zones (Z0, Z1, Z2) with profile skeleton lines of each zone (Z0, Z1, Z2) provided in each zone from the respective radially inner to the radially outer boundary to satisfy the equations:

$$\alpha^* = \frac{\alpha_1 - \alpha_P}{\alpha_1 - \alpha_2}$$

$$S^* = \frac{s_P}{S}$$

where

P is any point of the profile skeleton line,
$\alpha_1$ is angle of inclination at blade leading edge,
$\alpha_2$ is angle of inclination at blade trailing edge,
$\alpha^*$ is dimensionless, specific angle of total curvature,
S* is dimensionless; specific extension,
$\alpha_P$ is angle of tangent at any point P of profile skeleton line to central meridional flow line,
$s_P$ is extension of profile skeleton line at any point P, and
S is total extension of profile skeleton line.

12 Claims, 11 Drawing Sheets

Rotor blade in accordance with the present invention with radial gap on the casing

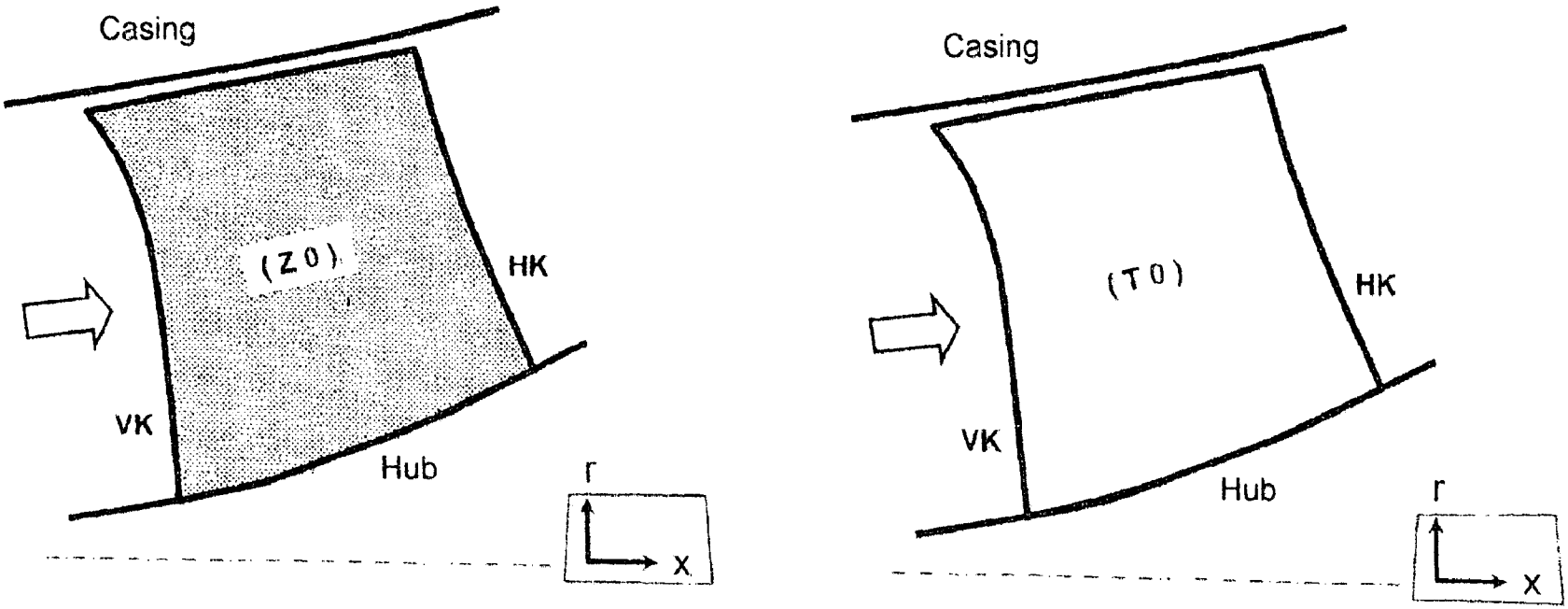
Fig. 1: Schematic representation of the state of the art

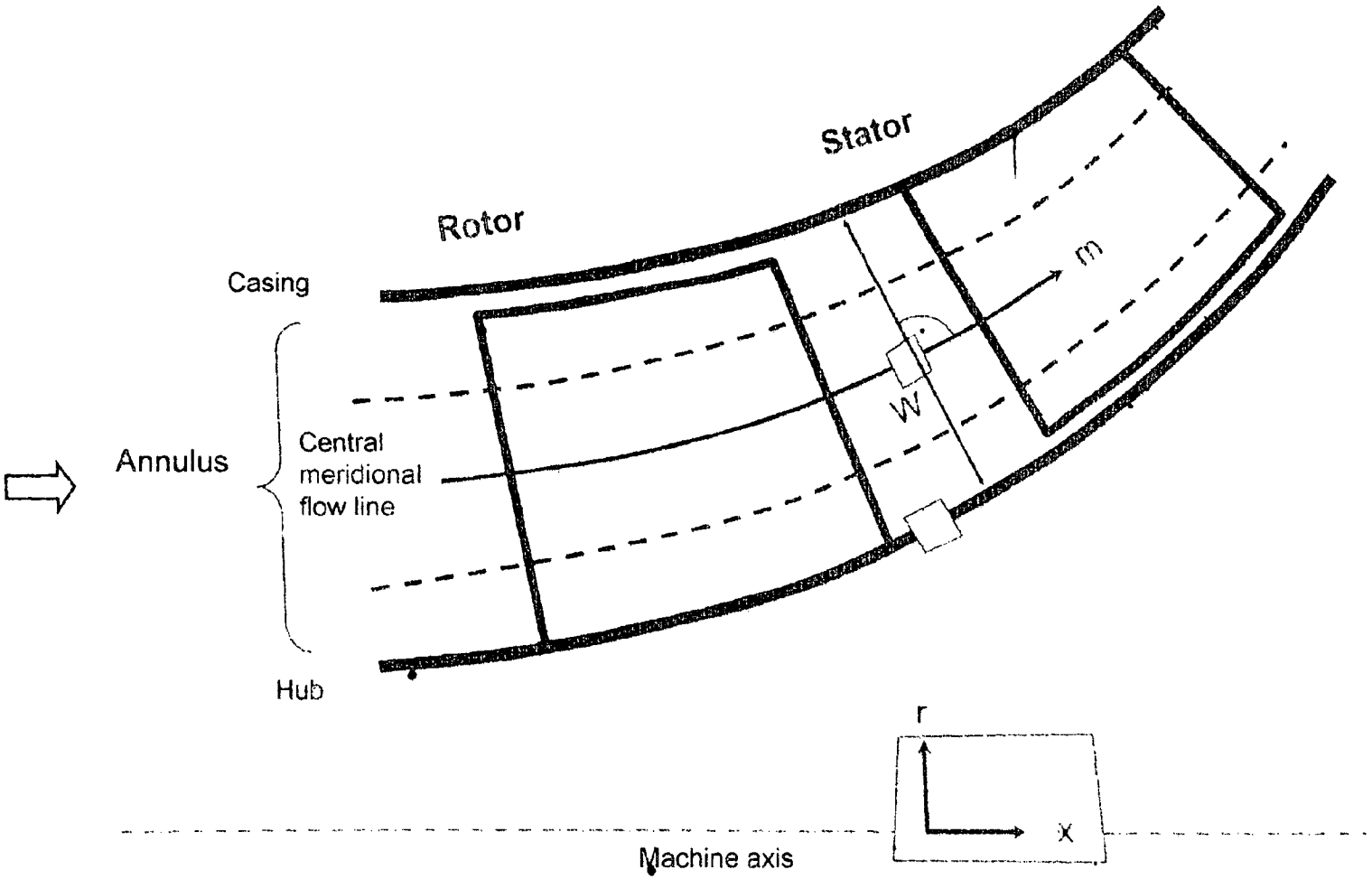
Fig. 2: Definition of meridional flow lines and flow line profile sections

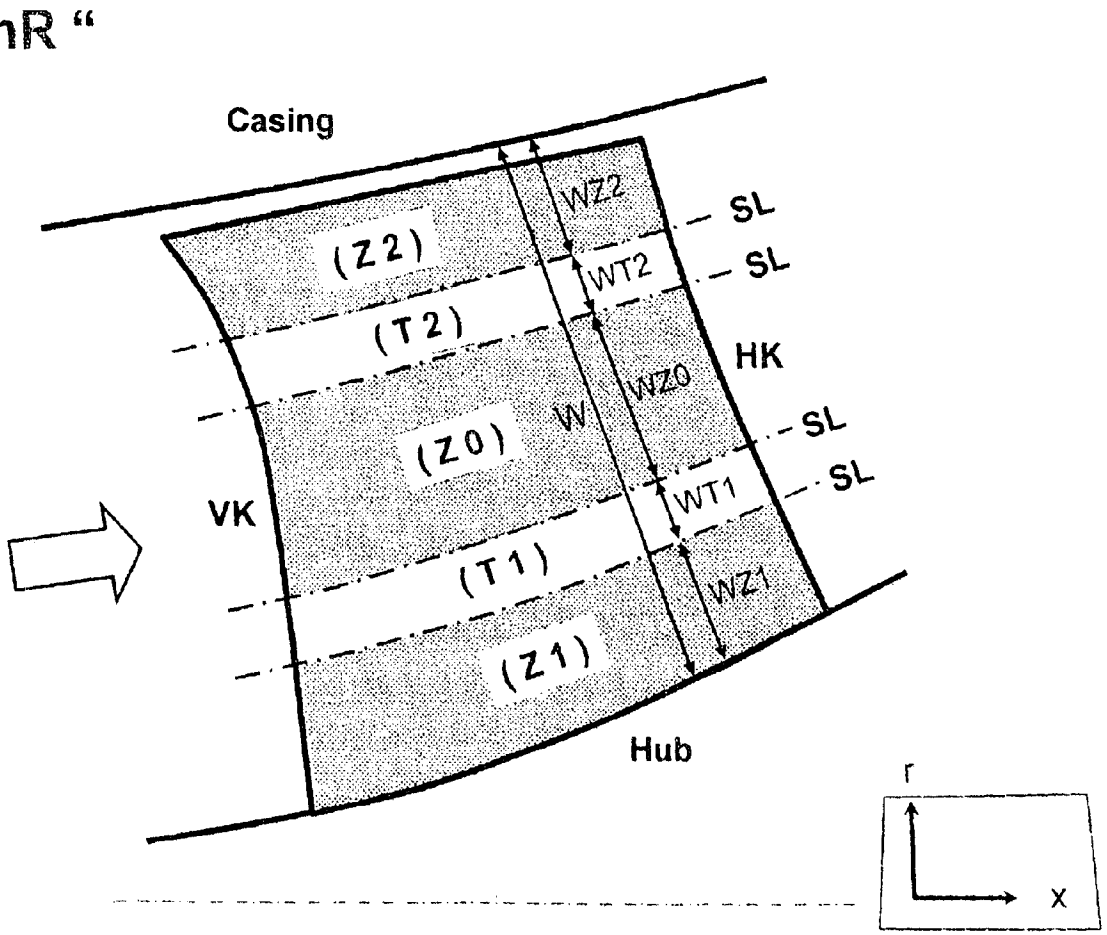
Fig. 3a: Rotor blade in accordance with the present invention with radial gap on the casing

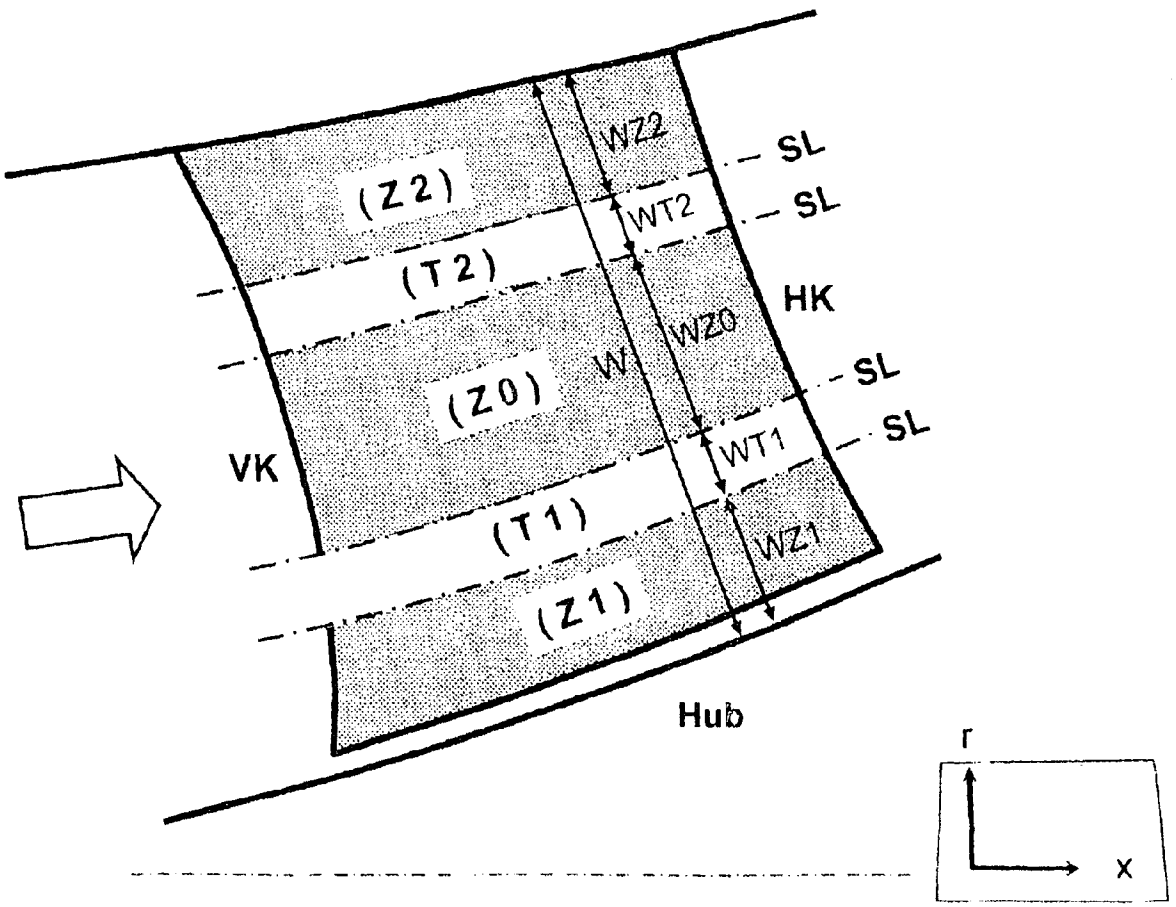
Fig. 3b: Stator blade in accordance with the present invention with radial gap on the hub

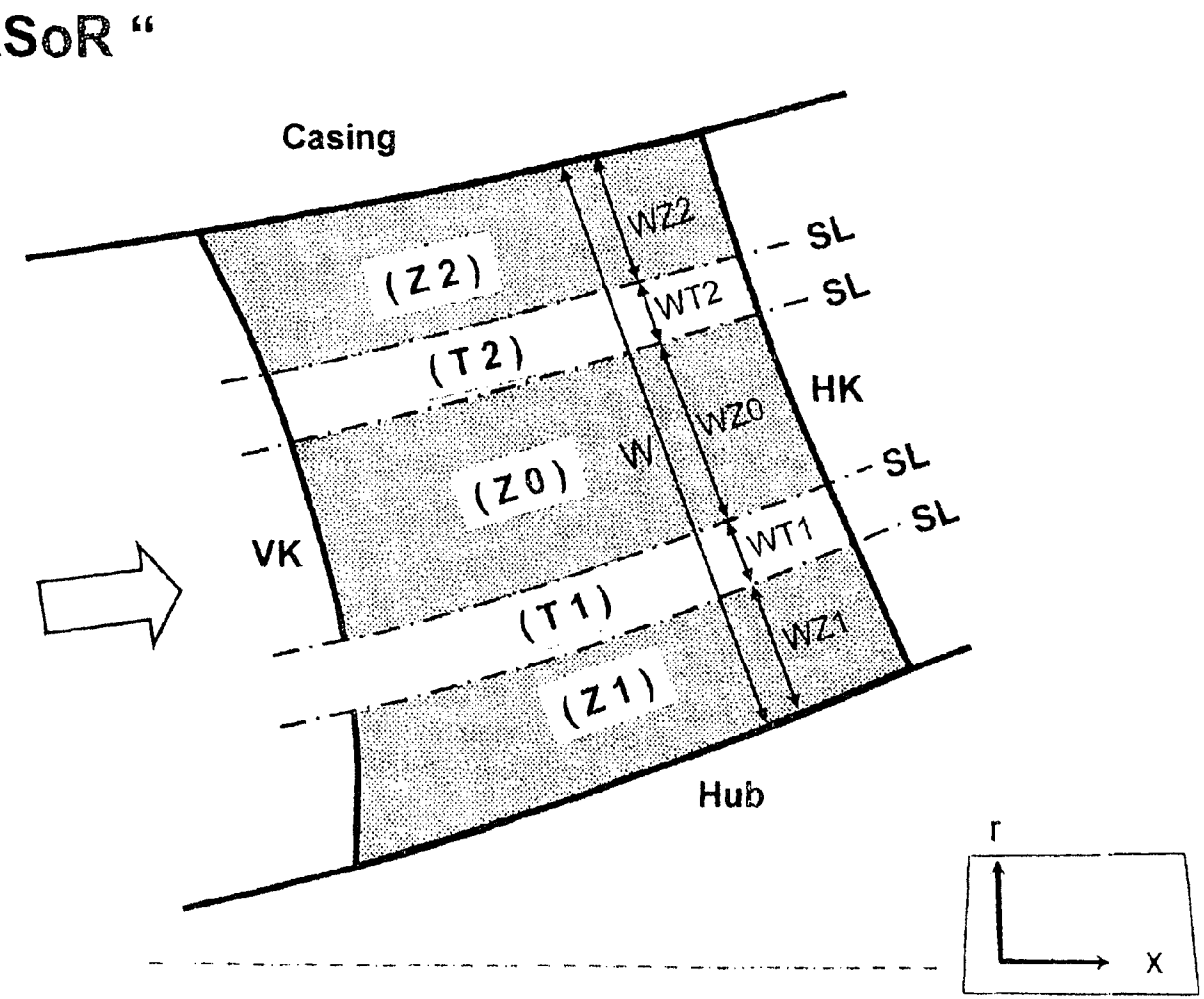
„ RSoR "
Fig. 3c: Rotor or stator blade in accordance with the present invention without radial gap Fig. 4: Definition of the height-to-side ratio HSV and of the zone widths WZ1, WT1, WZ0, WT2, WZ2
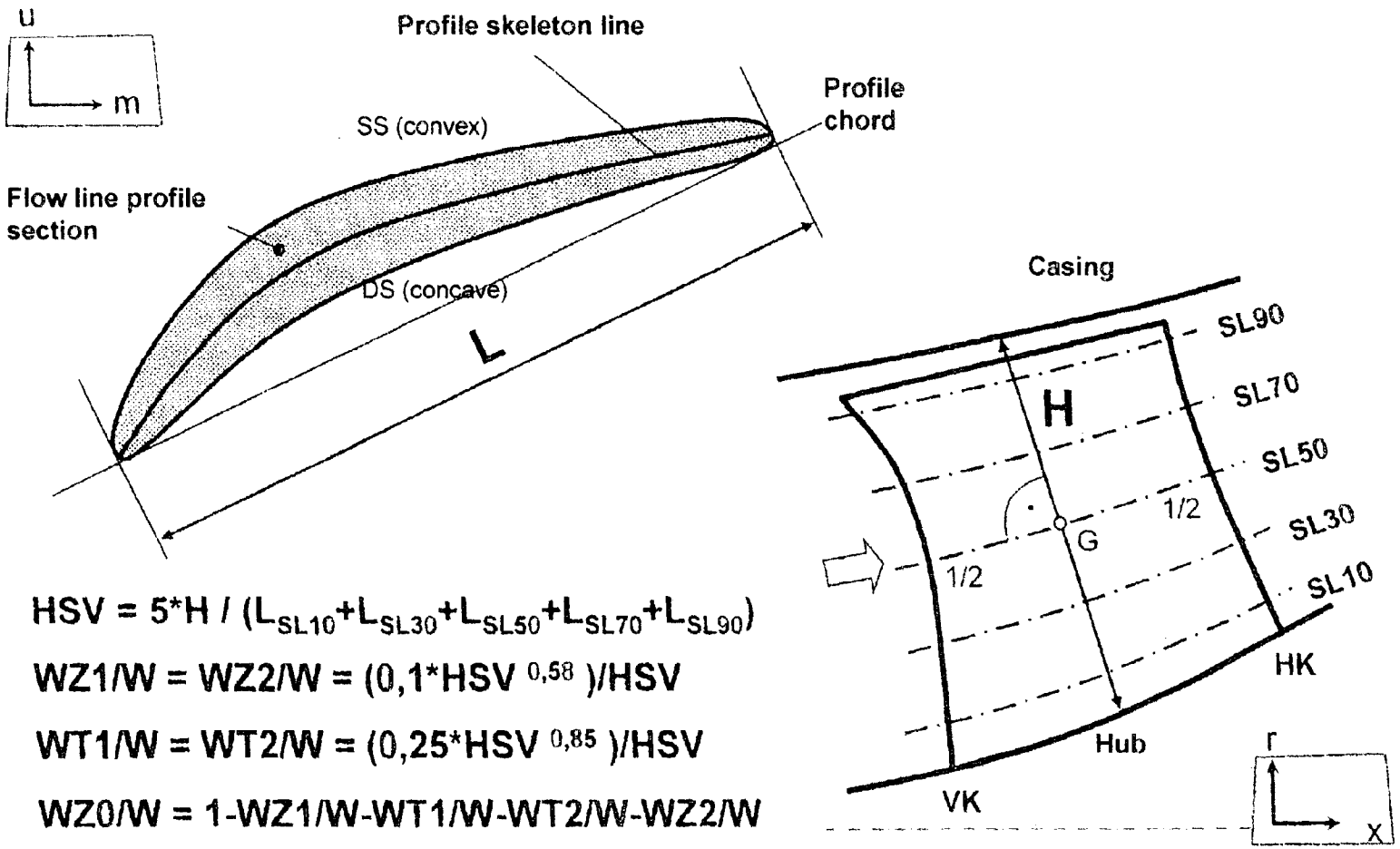

Fig. 5: Allocation of blade zones (Z1), (Z0), (Z2) and of defined types of skeleton lines PF, PM, PR in accordance with the present invention

| Zone | Types of skeleton lines on blade | | |
|---|---|---|---|
| | RmR | SmR | RSoR |
| (Z2) | PR | PF | PF |
| (Z0) | PM | PM | PM |
| (Z1) | PF | PR | PF |

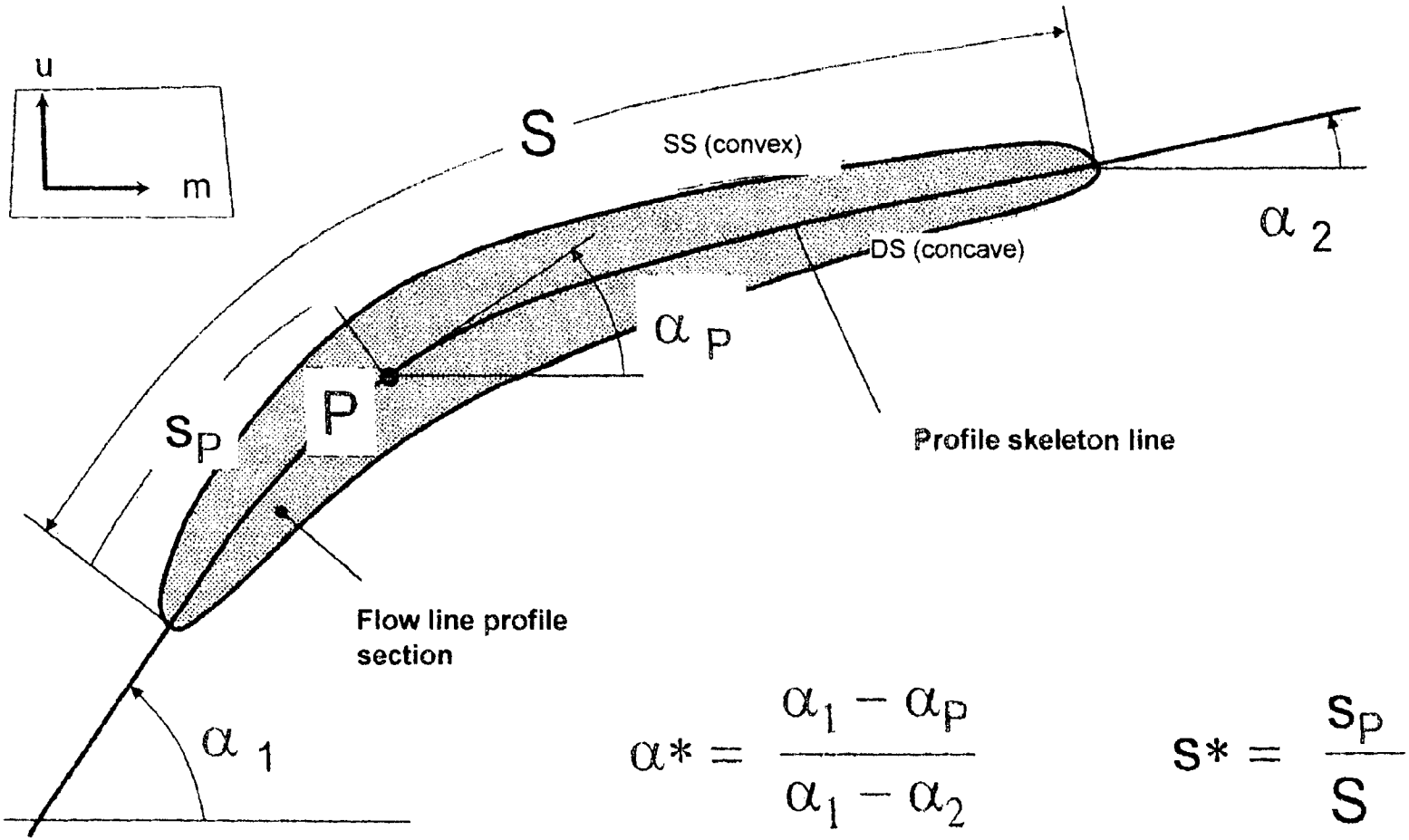
Fig. 6a: Definition of skeleton line of a flow line profile section

Fig. 6b: Definition of type of profile skeleton line "PF" for blade zone at firmly attached end
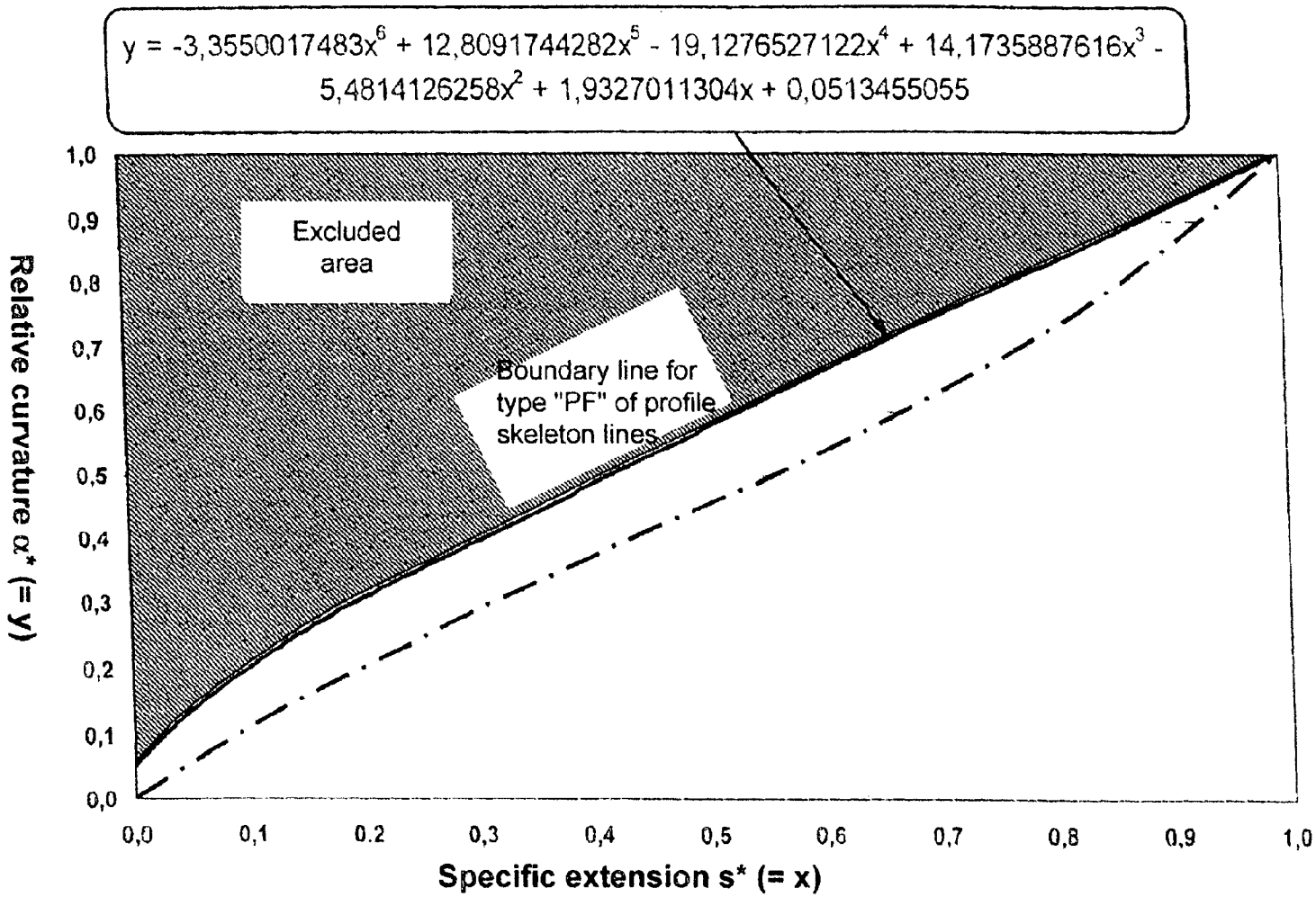

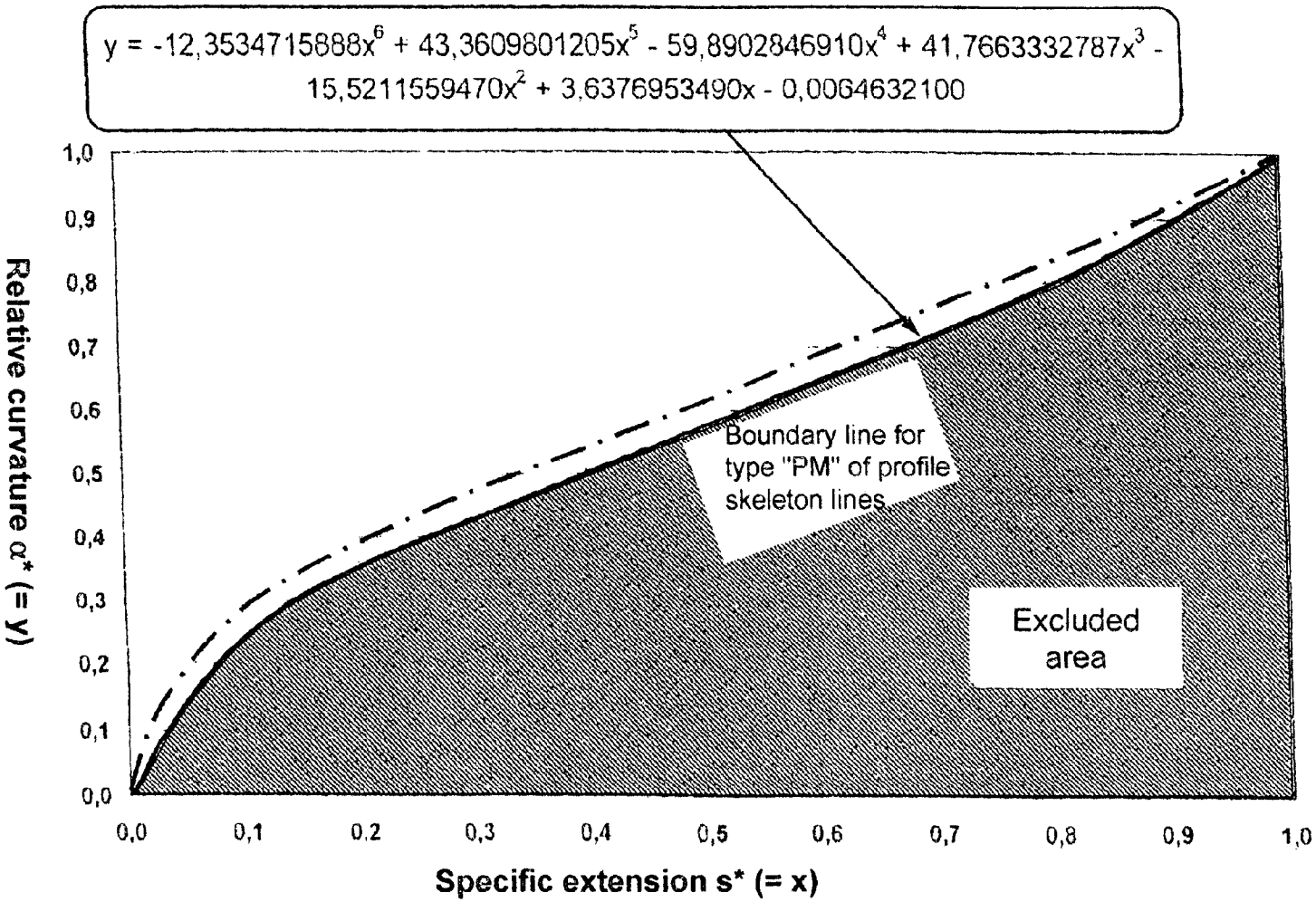
Fig. 6c: Definition of type of profile skeleton line "PM" for blade mid zone Fig. 6d: Definition of type of profile skeleton line "PR" for blade zone at radial gap
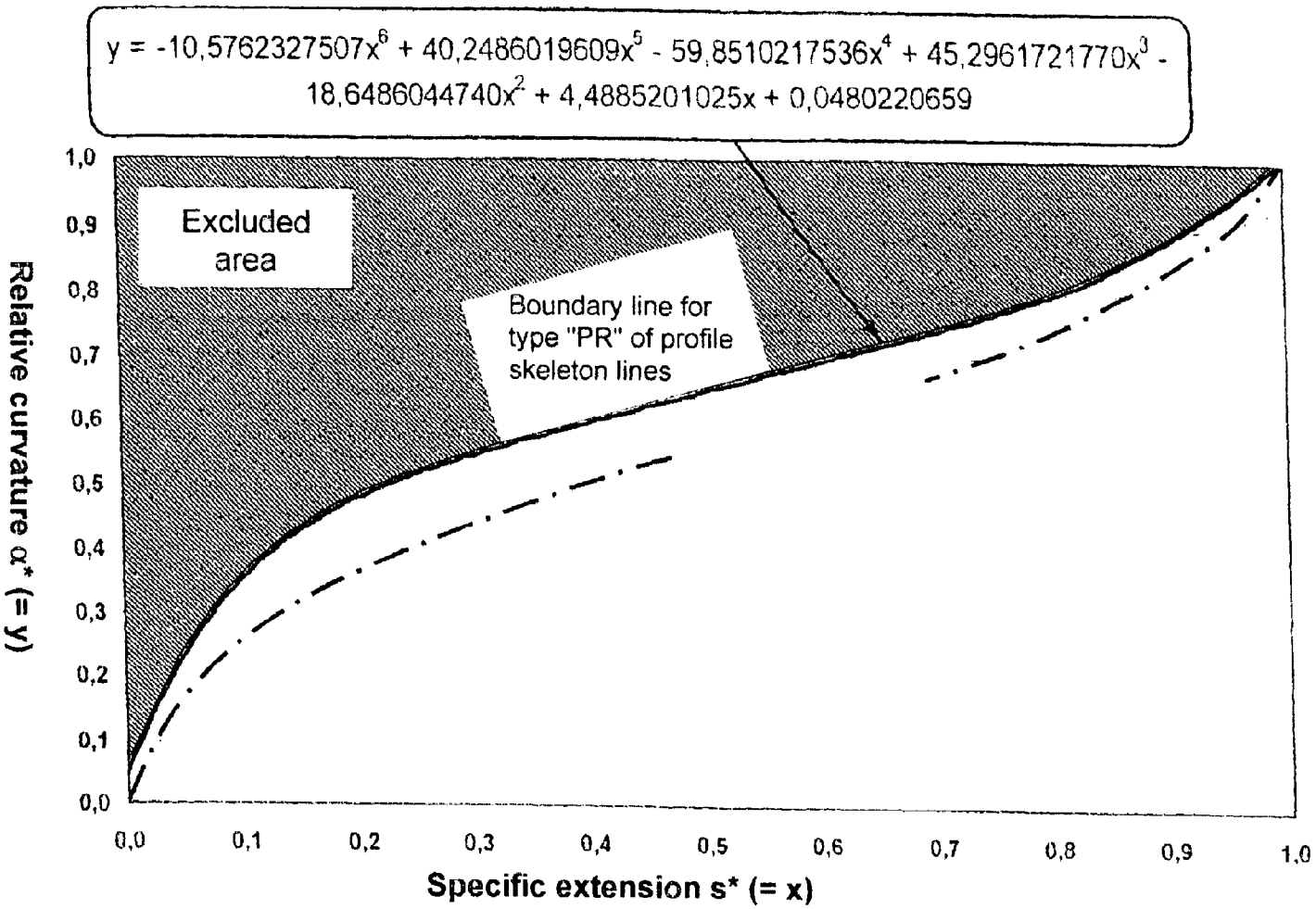

BLADE OF A TURBOMACHINE WITH BLOCK-WISE DEFINED PROFILE SKELETON LINE

This application claims priority to German Patent Application DE 10 2005 042 115.6 filed Sep. 5, 2005, the entirety of which is incorporated by reference herein.

The present invention relates to blades of turbomachines, such as blowers, compressors, pumps and fans of the axial, semi-axial or radial type. The working medium (fluid) may be gaseous or liquid.

More particularly, this invention relates to at least one blade of a turbomachine. The respective blading is situated within a casing, which confines the passage of fluid through a rotor and, if applicable, a stator in the outward direction. While a rotor comprises several rotor blades attached to a rotating shaft and transfers energy to the working medium, a stator consists of several stator blades mostly fixed in the casing.

The aerodynamic loadability and the efficiency of turbomachines, for example blowers, compressors, pumps and fans, is limited in particular by the growth and the separation of boundary layers in the area of the rotor and stator radial gaps and of the firmly attached blade ends near the walls of the annulus. The state of the art only partly provides solution to this fundamental problem. The general concept of boundary influencing by changing the type of skeleton line along the blade height is provided in the state of the art, however, the known solutions are not adequate and, therefore, of limited effectiveness only, in particular for the flow conditions at a blade end with radial gap.

FIG. 1 schematically shows two blade configurations in the meridional plane defined by the radial direction r and the axial direction x, these blade configurations corresponding to the state of the art.

On the left-hand side, a conventional blade without variation of the type of skeleton line is shown. In this simplest standard case, the blade consists of only one block (Z0) in which the type of the skeleton line is specified according to fixed rules. This category includes the so-called CDA (controlled diffusion airfoils) according to U.S. Pat. No. 4,431,376. Aerodynamically, CDA aim at a moderate profile front load.

On the right-hand side, a conventional blade with consistent variation of the type of skeleton line along the blade height is shown, this variation being not further specified. Here, the entire blade is represented by a correspondingly large transition zone (T0). This includes concepts from known publications providing for a rapid transition from a CDA type of skeleton line to a type of skeleton line that aims more at a profile back load in the blade outer areas (R. F. Behlke, Journal of Turbomachinery, Vol. 8, July 1986).

Besides, attempts exist to positively influence the peripheral zone flow by specially shaping the blade stacking axis, for example by imparting a bend, sweep or dihedral to the blading (see EP EP0661413A1, EP1106835A2, EP1106836A2).

The present invention relates to a rotor with firm attachment to the hub and a free blade end with radial gap towards the casing. Analogically, the present invention relates to a stator which peripherally is firmly connected on the casing side and whose blade end is free with radial gap on the hub side. Finally, the present invention relates to a rotor or a stator which peripherally is firmly connected on the hub and on the casing side (shrouded configuration).

As in all representations shown herein, inflow to the respective blade row is from the left to the right in the direction of the bold arrow.

The state of the art is disadvantageous in that the respective blade forms are designed, often deliberately, with low complexity regarding the shape of the skeleton line. Where different types of skeleton lines along the blade height are used, the character of the skeleton lines lacks block-wise markedness which would allow the profile pressure distribution in wall vicinity to be stronger influenced to obtain the maximum possible degree of gap and peripheral flow steadying. Furthermore, there is a lack of blade concepts with skeleton line distributions along the blade height which appropriately combine an extreme profile front load favorable in the blade mid area with a moderate profile back load favorable for the peripheral areas. Accordingly, the state of the art provides for an improvement in efficiency and stability of the turbomachine, but to a relatively small degree only. Consequently, the possible reduction in the number of components is only small.

A broad aspect of the present invention is to provide a rotor or stator blade of the type specified at the beginning above which, while avoiding the disadvantages of the state of the art, is characterized by exerting an effective influence on the peripheral flow due to a specific and problem-oriented block-wise definition of the profile skeleton lines along the blade height.

It is a particular object of the present invention to provide solution to the above problems by a combination of the characteristics described herein. Further advantageous embodiments of the present invention will be apparent from the description below.

The present invention provides for a rotor or stator blade for turbomachinery which features defined types of profile skeleton lines in different zones (blocks) of the blade height, limited by meridional flow lines, with the proviso that i) the distribution of the types of skeleton lines along the blade height advantageously combines an extremely aerodynamic profile front load in the blade mid area with an aerodynamic profile back load in the peripheral areas, ii) a specifically delimited type of skeleton line is provided throughout the defined peripheral zones Z1 and Z2, in accordance with the definition given further below, iii) the choice of the type of skeleton line in the transition zones T1 and T2 following Z1 and Z2 towards the blade center is optional, iv) a specifically delimited type of skeleton line according to the definition given further below is provided throughout the defined blade mid zone Z0.

The present invention is more fully described in the light of the accompanying drawings showing preferred embodiments. In the drawings, FIG. 1 is a schematic representation of the state of the art, FIG. 2 shows the definition of meridional flow lines and flow line profile sections, FIG. 3*a* shows the rotor blade according to the present invention with radial gap on the casing, FIG. 3*b* shows the stator blade according to the present invention with radial gap on the hub, FIG. 3*c* shows the rotor or stator blade according to the present invention without radial gap, FIG. 4 shows the definition of the height-to-side ratio HSV and of the individual zone widths (block widths) WZ1, WT1, WZ0, WT2, WZ2, FIG. 5 provides the allocation of the blade zones (Z1), (Z0), (Z2) according to the present invention and of the defined types of skeleton lines PF, PM, PR, FIG. 6*a* shows the definition of the skeleton line of a flow line profile section, FIG. 6*b* shows the definition of the type of skeleton line "PF" for the blade zone on the firmly attached end, FIG. 6*c* shows the definition of the type of profile skeleton line "PM" for the blade mid zone, FIG. 6*d* shows the definition of the type of profile skeleton line "PR" for the blade zone at the radial gap.

FIG. 2 provides a precise definition of the meridional flow lines and flow line profile sections. The central meridional flow line is established by the geometrical center of the annulus. If a normal is erected at any point of the central flow line, the annulus width W along the flow path and a number of normals are obtained, these enabling further meridional flow lines to be produced, with same relative division in the direction of the duct height. The intersection of a meridional flow line with a blade produces a flow line profile section.

FIG. 3*a* shows the rotor blade according to the present invention with radial gap on the casing "RmR" in the meridional plane defined by the axial coordinate x and the radial coordinate r. Here, the blade peripheral zones Z1 and Z2, the transition zones T1 and T2 and the blade mid zone Z0 are highlighted and limited by the respective meridional flow lines according to the definition in FIG. 2. A partial width (WZ1, WT1, WZ0, WT2, WZ2) is allocated to each of the five blade zones which is measured in the direction of the duct width W.

Analogically with this representation, FIG. 3*b* and FIG. 3*c* show the inventive stator blade with radial gap on the hub "SmR" as well as the inventive (rotor or stator) blade without radial gap "RSoR".

FIG. 4 shows the definition of the height-to-side ratio relevant for the determination of the respective zone width. The bottom right-hand half of the figure contains a sketch of a blade configuration with a number of meridional flow lines. Firstly, the central flow line, with the distance between the leading and the trailing edge being halved, defines the position for establishing the total blade height H (point G). Height H is established along a straight line normal to the central flow line in point G. Furthermore, five flow lines are defined at 10%, 30%, 50%, 70% and 90% of the duct width W (SL10, SL30, SL50, SL70, SL90) along which the respective chord length L is to be determined. The definition of L for any meridional flow surface (u-m plane) is shown in the upper left-hand half of the figure. The chord length resulting at xy% of the duct width is designated with LSLxy here and in the formulas of FIG. 4. The height-to-side ratio is finally to be determined a follows:

$$HSV=5\cdot H/(L_{SL10}+L_{SL30}+L_{SL50}+L_{SL70}+L_{SL90})$$

where

H is the height along a straight line normal to a central flow line in a point G, L is the length of the profile chord, and the individual lengths L of the profile chords are for five flow lines at 10%, 30%, 50%, 70% and 90% of a width W of the flow duct.

The zone widths are determined in dependence of the height-to-side ratio in relative form (related to the total duct width W) according to the following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W.$$

FIG. 5 shows in tabulated form the allocation according to the present invention of the three blade zones (Z1), (Z0), (Z2) and of the types of skeleton lines PF, PM, PR specified below (FIGS. 6*b*-*d*). For example, type PF is provided in zone (Z1), type PM in zone (Z0) and type PR in zone (Z2) for the blade configuration RmR.

PF—Type of profile skeleton line for the blade zone at the firmly attached end,

PM—Type of profile skeleton line for the blade mid zone,

PR—Type of profile skeleton line for the blade zone at the radial gap.

The respective type of skeleton line is defined in relative representation by way of the specific angle of inclination $\alpha^*$ and the specific extension S*, ref. FIG. 6*a*. The figure shows a flow line profile section of the blade on a meridional flow area (u-m plane).

For this, the angle of inclination $\alpha_P$ and the extension sp covered so far are determined in all points of the skeleton line. For reference, the inclination angle at the leading and trailing edge $\alpha$1 and $\alpha$2 and the skeleton-line total extension S are used. The following applies:

$$\alpha^* = \frac{\alpha_1 - \alpha_P}{\alpha_1 - \alpha_2}$$

$$S^* = \frac{s_P}{S}$$

FIG. 6*b* shows the definition of the type of skeleton line "PF" in the relative representation derived above. Skeleton line extensions according to the present invention are below the boundary line. Skeleton line extensions in the excluded area beyond and on the boundary line do not comply with the present invention. The boundary line for the type of skeleton line "PF" is given by the following definition:

$$\alpha^*=-3.3550017483\,S^{*6}+12.8091744282\,S^{*5}-19.1276527122\,S^{*4}+14.1735887616\,S^{*3}-5.4814126258\,S^{*2}+1.9327011304\,S^{*}+0.0513455055$$

A skeleton line distribution provided according to the present invention for the blade block at a firmly attached end is delineated by way of example.

FIG. 6*c* shows the definition of the type of skeleton line "PM" in relative representation. Skeleton line extensions according to the present invention are beyond the boundary line. Skeleton line extensions in the excluded area below and on the boundary line do not comply with the present invention. The boundary line for the type of skeleton line "PM" is given by the following definition:

$$\alpha^*=-12.3534715888\,S^{*6}+43.3609801205\,S^{*5}-59.8902846910\,S^{*4}+41.7663332787\,S^{*3}-15.5211559470\,S^{*2}+3.6376953490\,S^{*}-0.0064632100$$

A skeleton line distribution provided according to the present invention for the block at the blade center is delineated by way of example.

FIG. 6*d* shows the definition of the type of skeleton line "PR" in relative representation. Skeleton line extensions according to the present invention are below the boundary line. Skeleton line extensions in the excluded area beyond and on the boundary line do not comply with the present invention. The boundary line for the type of skeleton line "PR" is given by the following definition:

$$\alpha^*=-10.5762327507\,S^{*6}+40.2486019609\,S^{*5}-59.8510217536\,S^{*4}+45.2961721770\,S^{*3}-18.6486044740\,S^{*2}+4.4885201025\,S^{*}+0.0480220659$$

A skeleton line distribution provided according to the present invention for the blade block at the radial gap is delineated by way of example.

With the blade for turbomachines, such as blowers, compressors, pumps and fans, according to the present invention, peripheral flow influencing is achieved which is capable of increasing the efficiency of each stage by approx. 1 percent, with stability remaining unchanged. In addition, a reduction of the number of blades of up to 20 percent is possible. The concept according to the present invention is applicable to different types of turbomachines and, depending on the degree of utilization of the concept, yields savings in cost and weight of the turbomachine of 2 to 10 percent. In addition, the overall efficiency of the turbomachine is increased by up to 1.5 percent, depending on the application.

What is claimed is:

1. A fixed turbomachine blade with a profile skeleton line extending along a meridional flow line, the blade being radially divided into at least a mid zone and two peripheral zones with profile skeleton lines for a zone of the blade at a firmly attached end remaining below a limiting line given by the following equation:

$$\alpha^*=-3.3550017483\,S^{*6}+12.8091744282\,S^{*5}-19.1276527122\,S^{*4}+14.1735887616\,S^{*3}-5.4814126258\,S^{*2}+1.9327011304\,S^*+0.0513455055$$

where;

$$\alpha^* = \frac{\alpha_1 - \alpha_P}{\alpha_1 - \alpha_2}$$

$$S^* = \frac{s_P}{S}$$

and

P is any point of the profile skeleton line, $\alpha_1$ is an angle of inclination at a blade leading edge, $\alpha_2$ is an angle of inclination at a blade trailing edge, $\alpha^*$ is a dimensionless, specific angle of a total curvature, $S^*$ is a dimensionless, specific extension, $\alpha_p$ is an angle of a tangent at any point P of the profile skeleton line to a central meridional flow line, $s_p$ is an extension of the profile skeleton line at any point P, and S is a total extension of the profile skeleton line.

2. A blade in accordance with claim 1, with a profile skeleton line for the blade mid zone, remaining above a limiting line given by the following equation:

$$\alpha^*=-12.3534715888S^{*6}+43.3609801205\,S^{*5}-59.8902846910\,S^{*4}+41.7663332787\,S^{*3}-15.5211559470\,S^{*2}+3.6376953490\,S^*+0.0064632100.$$

3. A blade in accordance with claim 2 with a profile skeleton line for a zone of the blade at a radial gap, remaining below a limiting line given by the following equation:

$$\alpha^*=-10.5762327507\,S^{*6}+40.2486019609\,S^{*5}-59.8510217536\,S^{*4}+45.2961721770\,S^{*3}-18.6486044740\,S^{*2}+4.4885201025\,S^*+0.0480220659.$$

4. A blade in accordance with claim 3, with a height-to-side ratio (HSV) being determined to the following equation:

$$HSV=5\cdot H/(L_{SL10}+L_{SL30}+L_{SL50}+L_{SL70}+L_{SL90}).$$

where

H is a height along a straight line normal to a central flow line and intersecting a point G on the central flow line midway between a leading edge and a trailing edge of the bade, L is a length of a profile chord, and the individual lengths L of the profile chords are for five flow lines at 10%, 30%, 50%, 70% and 90% of a width W of a flow duct; and zone widths are determined in dependence of the height-to-side ratio (HSV) in relative form, related to the total duct width (W) according to following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W,$$

where

W is the duct width,

WZ1 is a duct width in a zone 1,

WZ2 is a duct width in a zone 2,

WZ0 is a duct width in a mid zone,

WT1 is a duct width in a transition zone between zone Z1 and zone Z0, and WT2 is a duct width in a transition zone between zone Z0 and Zone Z2.

5. A blade in accordance with claim 1 with a profile skeleton line for a zone of the blade at a radial gap, remaining below a limiting line given by the following equation:

$$\alpha^*=-10.5762327507\,S^{*6}+40.2486019609\,S^{*5}-59.8510217536\,S^{*4}+45.2961721770\,S^{*3}-18.6486044740\,S^{*2}+4.4885201025\,S^*+0.0480220659.$$

6. A blade in accordance with claim 1, with a height-to-side ratio (HSV) being determined to the following equation:

$$HSV=5\cdot H/(L_{SL10}+L_{SL30}+L_{SL50}+L_{SL70}+L_{SL90}),$$

where

H is a height along a straight line normal to a central flow line and intersecting a point G on the central flow line midway between a leading edge and a trailing edge of the blade, L is a length of a profile chord, and the individual lengths L of the profile chords are for five flow lines at 10%, 30%, 50%, 70% and 90% of a width W of a flow duct; and zone widths are determined in dependence of the height-to-side ratio (HSV) in relative form, related to the total duct width (W) according to the following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W,$$

where

W is the duct width,

WZ1 is a duct width in a zone 1,

WZ2 is a duct width in a zone 2,

WZ0 is a duct width in a mid zone,

WT1 is a duct width in a transition zone between zone Z1 and zone Z0, and WT2 is a duct width in a transition zone between zone Z0 and Zone Z2.

7. A fixed turbomachine blade with a profile skeleton line extending along a meridional flow line, the blade being radially divided into at least a mid zone and two peripheral zones with profile skeleton lines for a zone of the blade at a blade mid zone, remaining above a limiting line given by the following equation:

$$\alpha^*=-12.3534715888\,S^{*6}+43.3609801205\,S^{*5}-59.8902846910\,S^{*4}+41.7663332787\,S^{*3}-15.5211559470\,S^{*2}+3.63769534905\,S^*-0.0064632100$$

where:

$$\alpha^* = \frac{\alpha_1 - \alpha_P}{\alpha_1 - \alpha_2}$$

$$S^* = \frac{s_P}{S}$$

and

P is any point of the profile skeleton line, $\alpha_1$ is an angle of inclination at a blade leading edge, $\alpha_2$ is an angle of inclination at a blade trailing edge, $\alpha^*$ is a dimensionless, specific angle of a total curvature, S* is a dimensionless, specific extension, $\alpha_p$ is an angle of a tangent at any point P of the profile skeleton line to a central meridional flow line, $s_p$ is an extension of the profile skeleton line at any point P, and S is a total extension of the profile skeleton line.

8. A blade in accordance with claim 7 with a profile skeleton line for a zone of the blade at a radial gap, remaining below a limiting line given by the following equation:

$$\alpha^*=-10.5762327507\,S^{*6}+40.2486019609\,S^{*5}-59.8510217536\,S^{*4}+45.2961721770\,S^{*3}-18.6486044740\,S^{*2}+4.4885201025\,S^*+0.0480220659.$$

9. A blade in accordance with claim 8, with a height-to-side ratio (HSV) being determined to the following equation:

$$HSV=5\cdot H/(L_{SL10}+L_{SL30}+L_{SL50}+L_{SL70}+L_{SL90}),$$

where

H is a height along a straight line normal to a central flow line and intersecting a point G on the central flow line midway between a leading edge and a trailing edge of the blade, L is a length of a profile chord, and the individual lengths L of the profile chords are for five flow lines at 10%, 30%, 50%, 70% and 90% of a width W of a flow duct; and zone widths are determined in dependence of the height-to-side ratio (HSV) in relative form, related to the total duct width (W) according to the following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W,$$

where

W is the duct width,

WZ1 is a duct width in a zone 1,

WZ2 is a duct width in a zone 2,

WZ0 is a duct width in a mid zone,

WT1 is a duct width in a transition zone between zone Z1 and zone Z0, and WT2 is a duct width in a transition zone between zone Z0 and Zone Z2.

10. A blade in accordance with claim 7, with a height-to-side ratio (HSV) being determined to the following equation:

$$HSV=5\cdot H/(L_{SL10}+L_{SL30}+L_{SL50}+L_{SL70}+L_{SL90}),$$

where

H is a height along a straight line normal to a central flow line intersecting a point G on the central flow line midway between a leading edge and a trailing edge of the blade, L is a length of a profile chord, and the individual lengths L of the profile chords are for five flow lines at 10%, 30%, 50%, 70% and 90% of a width W of a flow duct; and zone widths are determined in dependence of the height-to-side ratio (HSV) in relative form, related to the total duct width (W) according to the following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W,$$

where

W is the duct width,

WZ1 is a duct width in a zone 1,

WZ2 is a duct width in a zone 2,

WZ0 is a duct width in a mid zone,

WT1 is a duct width in a transition zone between zone Z1 and zone Z0, and WT2 is a duct width in a transition zone between zone Z0 and zone Z2.

11. A fixed turbomachine blade with a profile skeleton line extending alone a meridional flow line, the blade being radially divided into at least a mid zone and two peripheral zones with profile skeleton lines for a zone of the blade at a radial gap, remaining below a limiting line given by the following equation:

$$\alpha^*=-10.5762327507\,S^{*6}+40.2486019609\,S^{*5}-59.8510217536\,S^{*4}+45.2961721770\,S^{*3}-18.6486044740\,S^{*2}+4.4885201025\,S^*+0.0480220659$$

where:

$$\alpha^* = \frac{\alpha_1 - \alpha_P}{\alpha_1 - \alpha_2}$$

$$S^* = \frac{s_P}{S}$$

and

P is any point of the profile skeleton line, $\alpha_1$ is an angle of inclination at a blade leading edge, $\alpha_2$ is an angle of inclination at a blade trailing edge, $\alpha^*$ is a dimensionless, specific angle of a total curvature, S* is a dimensionless, specific extension, $\alpha_P$ is an angle of a tangent at any point P of the profile skeleton line to a central meridional flow line, $S_P$ is an extension of the profile skeleton line at any point P, and S is a total extension of the profile skeleton line.

12. A blade in accordance with claim 11, with a height-to-side ratio (HSV) being determined to the following equation:

$$HSV=5\cdot H/(L_{SL10}+L_{SL30}+L_{SL50}+L_{SL70}+L_{SL90}),$$

where

H is a height along a straight line normal to a central flow line and intersecting a point G on the central flow line midway between a leading edge and a trailing edge of the blade, L is a length of a profile chord, and the individual lengths L of the profile chords are for five flow lines at 10%, 30%, 50%, 70% and 90% of a width W of a flow duct; and zone widths are determined in dependence of the height-to-side ratio (HSV) in relative form, related to the total duct width (W) according to the following rule:

$$WZ1/W=WZ2/W=(0.10\cdot HSV^{0.58})/HSV$$

$$WT1/W=WT2/W=(0.25\cdot HSV^{0.85})/HSV$$

$$WZ0/W=1-WZ1/W-WT1/W-WZT2/W-WZ2/W,$$

where

W is the duct width,

WZ1 is a duct width in a zone 1,

WZ2 is a duct width in a zone 2,

WZ0 is a duct width in a mid zone,

WT1 is a duct width in a transition zone between zone Z1 and zone Z0, and WT2 is a duct width in a transition zone between zone Z0 and Zone Z2.

* * * * *